US005520464A

United States Patent [19]

Kristola

[11] Patent Number: 5,520,464

[45] Date of Patent: May 28, 1996

[54] HEAT SEAL SOS BAG

[75] Inventor: Jay L. Kristola, Kiel, Wis.

[73] Assignee: H.G. Weber and Company, Inc., Kiel, Wis.

[21] Appl. No.: 249,236

[22] Filed: May 25, 1994

[51] Int. Cl.[6] ..... B65D 30/12

[52] U.S. Cl. ..... 383/126

[58] Field of Search ..... 383/126, 121, 383/124, 125

[56] References Cited

U.S. PATENT DOCUMENTS

| | | | |
|---|---|---|---|
| 333,523 | 1/1886 | Honiss . | |
| 388,614 | 8/1888 | Appel . | |
| 2,059,200 | 11/1936 | Bancroft | 383/126 X |
| 2,074,277 | 3/1937 | Schmidt | 383/126 |
| 2,078,467 | 4/1937 | Sterling | 383/126 X |
| 2,353,605 | 7/1944 | Waters . | |
| 2,444,752 | 7/1948 | Waters . | |
| 2,496,796 | 2/1950 | Kardon . | |
| 2,777,368 | 1/1957 | Koop . | |
| 3,237,534 | 3/1966 | Lissner . | |
| 3,342,402 | 9/1967 | Kardon . | |
| 3,397,622 | 8/1968 | Goodwin . | |
| 3,734,395 | 5/1973 | Erk et al. . | |
| 4,490,131 | 12/1984 | Coleman et al. . | |

FOREIGN PATENT DOCUMENTS

| | | |
|---|---|---|
| 688088 | 6/1964 | Canada . |
| 1175846 | 4/1959 | France . |
| 2393673 | 1/1979 | France . |

*Primary Examiner*—Jes F. Pascua
*Attorney, Agent, or Firm*—Hill, Steadman & Simpson

[57] ABSTRACT

A self-opening style bag formed of a tube with a bottom constructed of folded-inward-portions of side walls and overlying portions of front and rear walls, all folded around a perimeter fold line. The tube provides adhesive strips on portions of the bottom region of the tube to assemble the bottom of the bag wherein at least the front wall and rear wall have transverse adhesive strips applied adjacent the fold line and edge strips along edges in the bottom region. The side walls have adhesive applied along bottom edges thereof. Alternately a heat sealable material is applied over an inside surface of the bag and local heating is used to effect seals. When the side walls are folded inward, they are sealed at all seams in the bottom of the bag to prevent small articles from becoming trapped between seams.

6 Claims, 2 Drawing Sheets

HEAT SEAL SOS BAG

BACKGROUND OF THE INVENTION

The present invention relates to bags. More specifically, the present invention relates to self-opening style or self-opening square bags, referred to in the industry as SOS bags. This type of bag has a folded bottom, and is typically used for grocery sacks, lunch sacks, microwave popcorn sacks and other bags which are required to stand on their own when opened. Such SOS bags are disclosed in U.S. Pat. No. 3,669,347 and U.S. Pat. No. 3,606,822.

Tubular bags with gussetted sides are known. Because the bottom of such a bag is folded, the interior of the bag has folded-over flaps. Unfortunately, small objects within the bag can become trapped under the flaps, making them difficult to retrieve.

It is known to apply an adhesive to the inside of a tubular bag to form the square bottom. However, the adhesive in prior art bags has not been effectively placed so that the bottom flaps are adequately secured. Some prior art configurations secure interior flaps by gluing an insert strip over certain flap edges. For example, U.S. Pat. No. 3,734,395 relates to such a bag.

SUMMARY OF THE INVENTION

The present invention provides a novel SOS bag which utilizes a tube with gussetted sides having a select pattern of adhesives applied on portions of the interior of the bag, near one end of the tube. The pattern is such that upon folding of the bag, a flat bottom is achieved which completely secures all interior flap edges.

To this end, in an embodiment, a flat-bottom bag is provided. The bag has a generally planar front wall, a generally planar rear wall substantially parallel to the front wall, and gussetted side walls connecting the front and rear walls. The walls form a tube having a top and bottom edge. The bag has a bottom end folded to provide a flat bottom. The bottom has a flap of the front wall formed by parallel slits and folded along a fold line. Adhesive is applied on an inside surface of the front and rear walls extending longitudinally from the bottom edge along edge regions adjacent the right and left walls. Adhesive is applied in transverse regions across the front and rear walls connecting the edge regions. Adhesive is applied to side regions across the left and right walls adjacent the bottom edge and connecting the edge regions. Adhesive is applied to a bottom edge region across the rear wall, connecting edge regions of the rear wall at the bottom edge.

In an embodiment, one adhesive can be printed and dried on the bag and then reactivated by heat.

In an embodiment, the adhesive is Heat Seal Polyvinyl Acetate.

In an embodiment, the adhesive is Heat Seal Polyvinyl Alcohol.

In an embodiment, the adhesive is positioned in a strip disposed adjacently to the fold lines.

In a further embodiment, the bag material can include heat actuated adhesive applied over it entire inside surface and select regions can be heat activated for formation of the bag bottom. Advantageously, the bag can be made of a 100% heat sealable liner material. Heat can thus be applied to the select areas of the bag according to the invention to make the bag leak proof.

An advantage of the present invention is to provide a bag that prevents objects contained therein from becoming entrapped under edges of a folded bottom.

A further advantage of the present invention is to provide a bag that has an efficient adhesive pattern that results in a beneficial sealing of a folded bottom.

Additional features and advantages of the present invention are described in, and will be apparent from, the detailed description of the presently preferred embodiments and from the drawings.

DETAILED DESCRIPTION OF THE PREFERRED EMBODIMENTS

Figure 1:
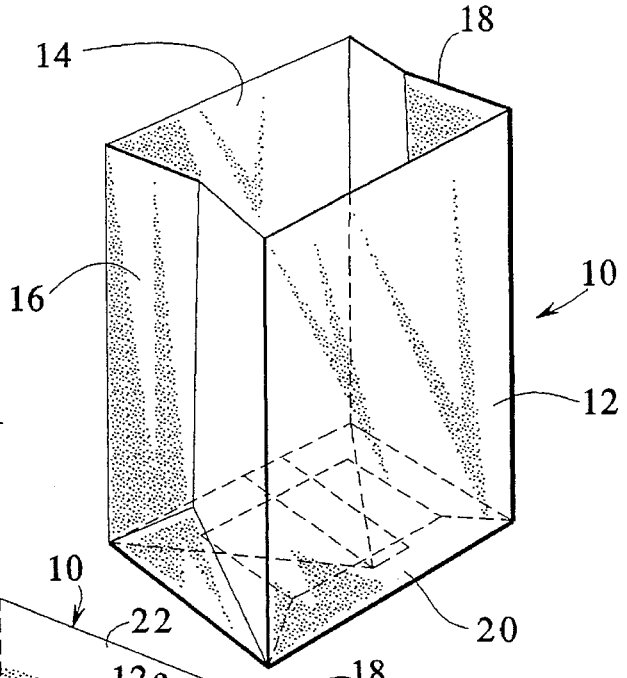
FIG. 1 is a perspective view of a completed bag in accordance with the present invention.

FIG. 1 illustrates a bag 10 manufactured according to the method of the present invention. The bag has a front panel 12, a rear wall 14, a left wall 16 and a right wall 18. A floor structure 20 completes the bag 10.

Figure 2:
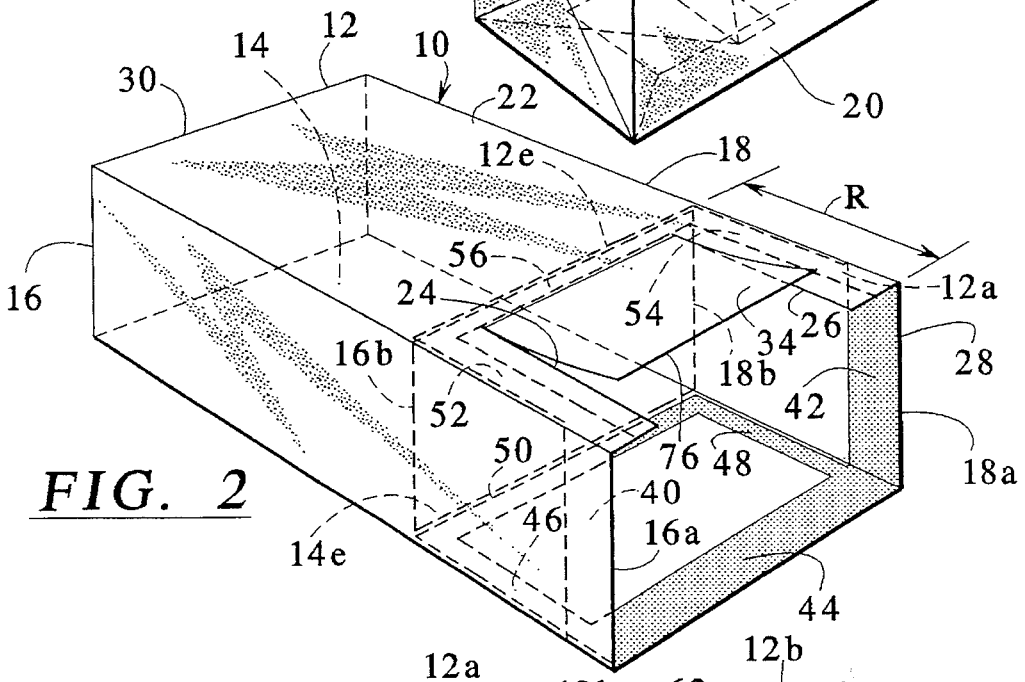
FIG. 2 is a perspective view of the bag of FIG. 1 in a preassembled condition.

FIG. 2 illustrates the bag 10 before construction of the floor structure 20. The bag 10 comprises a square tube 22 having a bottom region R. In the bottom region R, the front panel 12 has two parallel longitudinal slits 24, 26 extending from a bottom edge 28 toward a top end 30. These slits 24, 26 form a leading flap 34. An end 36 of the leading flap 34 terminates recessed from the edge 28 of the tube 22.

Adhesive such as temperature actuated adhesive is located in specific regions of the bottom region R as will now be described. Alternately, the entire inside surface of the bag can be a heat sealable liner material and the liner material can be selectively heat activated in the specific regions described below. Adhesive is deployed in side bands 40, 42 on the side walls 16, 18 connected by a bottom band 44 on the rear wall 14. The side bands 40, 42 and the bottom band 44 are adjacent the edge 28 of the tube. Extending longitudinally on the rear wall 14 from the bottom band 44 are rear edge regions 46, 48 which extend adjacent the side walls 16, 18 on the rear wall 14. Spaced parallel from the bottom band 44 and connecting the rear edge regions 46, 48 is a transverse rear band 50. The rear edge regions 46, 48, the transverse rear band 50 and the bottom band 44 form a rectangular configuration on the rear wall 14. On the front wall 12 are arranged front edge regions 52, 54 which connect to the side bands 40, 42 and extend adjacent the side panels 16, 18. Spaced from the edge 28 and connecting ends of the front edge regions 52, 54 is a transverse front band 56.

The front side bands 52, 54 and the transverse front band 56 form a U-shape.

Figure 3:
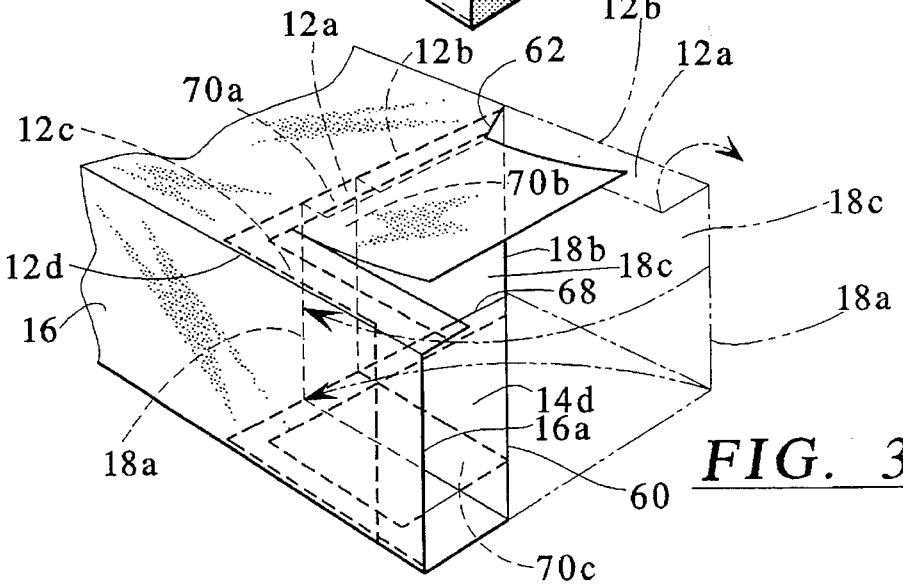
FIG. 3 is a partial perspective view of the bag of FIG. 2 in a further stage of assembly.

FIG. 3 illustrates an intermediate stage of assembly of the bag wherein a side edge 18*a* is folded toward the opposite side 16 along a rear fold line 60 and a front fold line 62, wherein a front panel portion 12*a* is inverse folded along its edge 12*b* which changes the orientation of the adhesive strip at front edge region 54 to facing predominantly upwardly in FIG. 3. The edge region 54 now aligns with the transverse front band 56 to be fastened thereto. By folding along the line 60 the rear edge region 48 changes from facing predominantly upwardly in FIG. 2 to facing predominantly downwardly in FIG. 3 and aligned with the transverse rear band 50 to be attached thereto. The right side panel 18 is folded about the fold line 18*b* and the fold line 60 into a right bottom panel 18*c* and a bottom triangular portion 14*d*, separated by a fold line 68.

Figure 4:
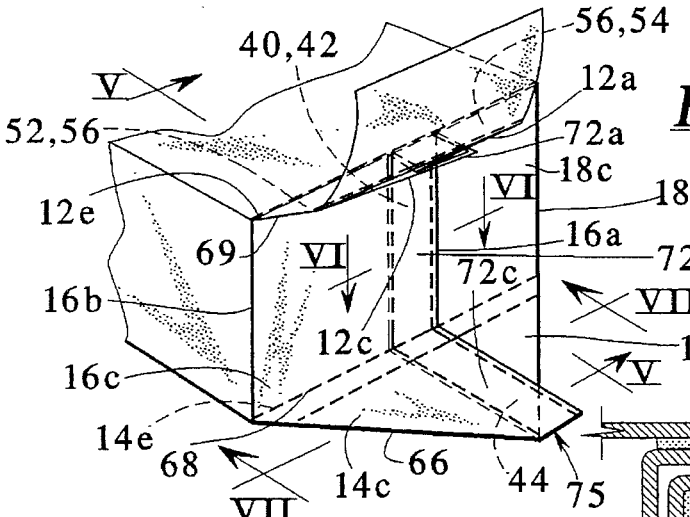
FIG. 4 is a partial perspective view of the bag of FIG. 3 in a further stage of assembly.

Next, as shown in FIG. 4, a side edge 16*a* is folded toward the right wall 18 about a fold line 16*b* of the side wall 16 and about a fold line 66 on the rear wall 14, forming a fold line 68.

The left side panel 16 and portion of the bottom panel 14 is folded into a left bottom panel 16*c* and a bottom triangular portion 14*c* separated by the fold line 68. A front panel portion 12*c* is reverse folded along the edge 12*d* about a fold line 69 in generally mirror image fashion to the folding of the right side panels 12*a*. The rear edge region 46 matches to the rear transverse band 50 and the front edge region matches to the front transverse and 56. It is apparent that the front and rear transverse bands 56, 50 are applied adjacent to the fold lines 12*e*, 14*e* respectively, on a side thereof toward the bottom edge. Also, the location of the fold lines 16*b*, 18*b*, 12*e*, 14*e* from the bottom edge 28 are selected that the length of each of the edge regions 46, 48, 52, 54 corresponds to at least approximately half the length of each of the transverse bands 50, 56 and an addition length to form part of a seam as described below.

Contiguous rectangular portions 70*a*, 70*c* are folded outwardly from the front panel portion 12*a*, the right bottom panel 18*c*, and the bottom triangular portion 14*d* and underlie contiguous rectangular portions 72*a*, 72*b*, 72*c*, folded outwardly from the front panel portion 12*c*, the left bottom panel 16*c* and the bottom triangular portion 14*c*, respectively, forming a seam 75.

The seam 75 is folded over flat against the right bottom panel 18*c*, the front panel portion 12*a* and the triangular portion 14*d*.

To further explain the folding configuration of FIGS. 3 and 4, FIGS. 5, 6 and 7 cross sectional views of the panel portions folded and adhesively secured together at locations shown in FIG. 4.

Figure 5:
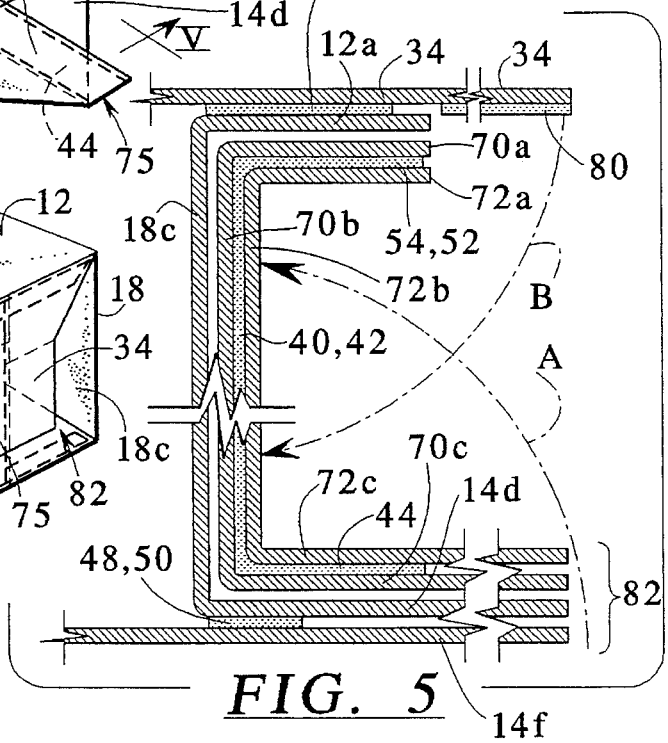
FIG. 5 is a sectional view taken generally through V-V of FIG. 4.
Figure 6:
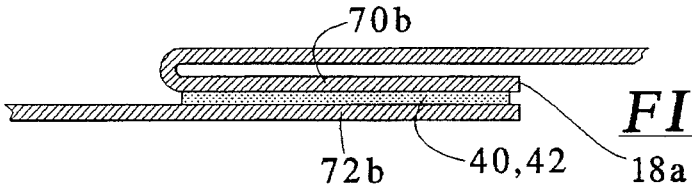
FIG. 6 is a sectional view taken generally along VI-VI of FIG. 4.
Figure 7:
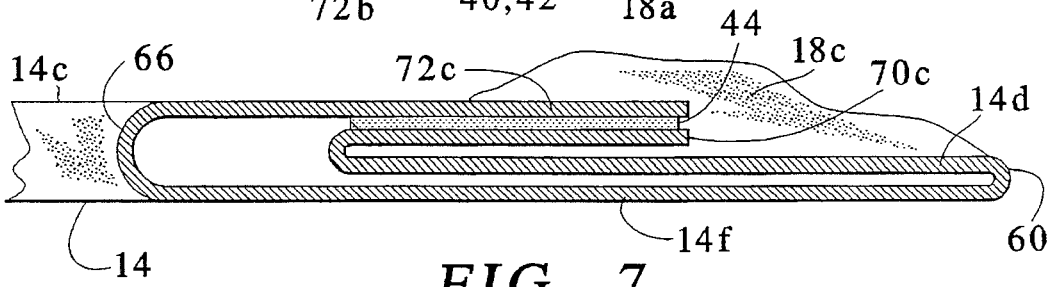
FIG. 7 is a sectional view taken generally along VII-VII of FIG. 4.

FIG. 5 shows an adhesive portion 80 on an inside surface of the leading flap 34. When a trailing flap 82 formed by the portions 14*c*, 72*c*, 70*c*, 14*d* and a rear wall triangle 14*f* are folded upward in the direction A to press against the panel portion 72*b*, the leading flap 34 is then folded downward in the direction B and it is adhesively glued with the adhesive 80 to the rear wall triangle 14*e*.

Advantageously, heat seal polyvinyl acetate or heat seal polyvinyl alcohol is used in the adhesive regions although the region 80 can be any glue or paste. When heat is applied, temperature actuated adhesive overlying adhesive will bind together.

Heat actuated adhesive is advantageous in that the adhesive used is not "sticky" or "tacky" during the folding operation and is effectively rendered "sticky" only at elevated temperature. Thus, not only during folding are the adhesive strips non-sticky, but any exposed adhesive after heating and cool down returns to a non-sticky or non-tacky state. This avoids objects adhering to bag surfaces.

Figure 8:
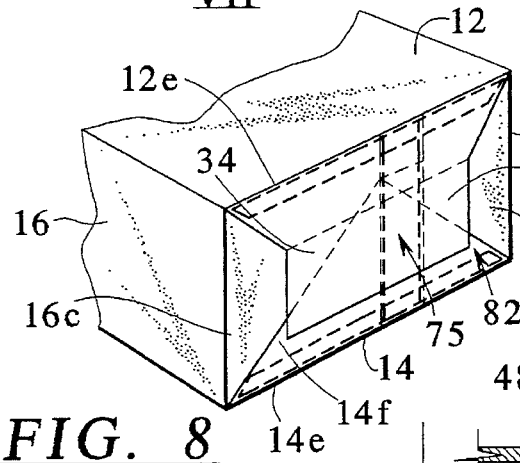
FIG. 8 is a perspective view of the bag shown in FIG. 4 in a final stage of assembly.

The bag bottom is now complete as shown in FIG. 8. All seams in the bottom are sealed preventing trapping of small items under loose flaps or within folds.

Although the present invention has been described with reference to a specific embodiment, those of skill in the art will recognize that changes may be made thereto without departing from the scope and spirit of the invention as set forth in the appended claims.

I claim as my invention:

1. A bag comprising:

a front wall, two side walls and a rear wall and a top open end and a bottom wall, portions of said side walls folded inwardly to form said bottom wall; and defined elongate rectangular adhesive regions applied along a width of said front and rear walls to adhesively secure said portions of said side walls to said front and rear walls, and a seam adhesive region arranged between said portions of said side walls across said bottom wall of said bag, to effectively seal all seams in said bottom wall of said bag to prevent trapping of material therein;

wherein said portions of said side walls are folded to have a combined width greater than a width of said front wall and having outwardly turned flanges to form an outwardly turned seam and a portion of said front wall and a portion of said rear wall are folded inwardly overlapping said seam to overlie said bottom wall, and said seam adhesive region is arranged between said turned flanges; and wherein said portion of said rear wall comprises a double wall thickness triangle and said portion of said front wall comprises a single wall thickness flap.

2. A tube with pre-applied adhesive for fold-forming into a bag, comprising:

a front wall, rear wall, right side wall, and left side wall forming a rectangular tube with an open top end and an open bottom edge;

two slits on said front wall extending longitudinally from said bottom edge toward said open end to a first longitudinal distance;

said rear wall without slits, solid to the bottom edge;

adhesive applied only within a first transverse strip applied across an inside of said front wall at a second longitudinal distance from said bottom edge greater than said first longitudinal distance;

adhesive applied only within a second transverse strip applied across said rear wall at said second longitudinal distance from said bottom edge;

adhesive applied only within first and second edge strips applied onto said front wall from opposite ends of said first transverse adhesive strip longitudinally along said right and left side walls for a distance approximately half the length of said first transverse strips;

adhesive applied only within third and fourth edge strips applied onto said rear wall from opposite ends of said second transverse adhesive strip longitudinally along said right and left side walls for a distance approximately half the length of said second transverse strip.

3. The tube according to claim 2 further comprising;

adhesive applied within a first side strip applied across said left side wall along said bottom edge; and adhesive applied within a second side strip applied across said right side wall along said bottom edge.

4. The tube according to claim 2, wherein said adhesive comprises a heat actuated adhesive.

5. A tube with pre-applied adhesive for fold-forming into a bag, comprising:

a front wall, rear wall, right side wall, and left side wall forming a rectangular tube with an open top end and an open bottom edge;

two slits on front wall extending longitudinally from said bottom edge toward said open end to a first longitudinal distance;

said rear wall without slits, solid to the bottom edge;

adhesive applied only within a first transverse strip applied across an inside of said front wall at a second longitudinal distance from said bottom edge greater than said first longitudinal distance;

adhesive only within a second transverse strip applied across said rear wall at said second longitudinal distance from said bottom edge;

adhesive applied only within first and second edge strips applied onto said front wall from opposite ends of said first transverse adhesive strip longitudinally along said right and left side walls for a distance approximately half the length of said first transverse strips;

adhesive applied only within third and fourth edge strips applied onto said rear wall from opposite ends of said second transverse adhesive strip longitudinally along said right and left side walls for a distance approximately half the length of said second transverse strip;

adhesive applied within a first side strip applied across said left side wall along said bottom edge;

adhesive applied within a second strip applied across said right side wall along said bottom edge; and adhesive applied within a rear wall strip applied across the rear wall along the bottom edge and connecting said first and second side strips.

6. The tube according to claim 5, wherein said front wall between said slits is recessed longitudinally inward of said bottom edge.

* * * * *